United States Patent [19]

Sano

[11] 4,428,311

[45] Jan. 31, 1984

[54] PATTERN SELECTING DEVICE FOR SEWING MACHINES

[75] Inventor: Yasuro Sano, Hachioji, Japan

[73] Assignee: Janome Sewing Machine Co. Ltd., Tokyo, Japan

[21] Appl. No.: 332,352

[22] Filed: Dec. 18, 1981

[30] Foreign Application Priority Data

Dec. 24, 1980 [JP] Japan ..... 55-184822[U]

[51] Int. Cl.[3] ..... D05B 3/02

[52] U.S. Cl. ..... 112/158 A

[58] Field of Search ..... 112/158 A, 158 D, 158 R

[56] References Cited

U.S. PATENT DOCUMENTS 3,795,210 3/1974 Adams et al. ..... 112/158 D 4,368,681 1/1983 Hanyu et al. ..... 112/158 A

*Primary Examiner*—Peter P. Nerbun

*Attorney, Agent, or Firm*—Michael J. Striker

[57] ABSTRACT

A pattern selecting device for a sewing machine comprising a first cam group of the machine for swinging the needle bar thereof and adapted to be rotated at a predetermined speed reduced with respect to the speed of the main shaft of the sewing machine, a second cam group for swinging the needle bar, rotated at further speed reduction, and an amplitude transmission lever having a follower engageable with the cams of the first cam group, said lever being provided with two members each carrying a respective follower one of which is engageable with the cams of the second cam group and the other engageable with the pattern selecting cam controllable by a rotatable dial.

4 Claims, 11 Drawing Figures

PATTERN SELECTING DEVICE FOR SEWING MACHINES

BACKGROUND OF THE INVENTION

The invention relates to a pattern selecting mechanism for sewing machines, in which two cam groups are disposed within a limited space of an arm frame of a sewing machine, which are different in speed reduction ratios with respect to a main shaft thereof, whereby various kinds of patterns are made available in cooperation with an automatic feed arm.

In a sewing machine housing the pattern cams therein, a needle bar is given lateral swinging amplitude by one cam selected from a pattern generating cam group to be rotated at speed reduction with respect to the main shaft. There have conventionally been two thinkings in designing thoughts of said pattern cam built-in sewing machine. One of them is to make much account of applicability of the stitching pattern to make large the speed reduction ratio of the pattern cam by neglecting a consequently large volume of the pattern generating cam group. The other is to make much account of a small volume of the pattern cam group to make small the speed reduction ratio of the pattern cam by sacrificing the applicability of the stitching pattern. That is, since the pattern generating cam must not move the needle bar in a swinging direction during penetration of a needle into a fabric under sewing, the needle bar should be held at predetermined position while an upper shaft of the sewing machine rotates at least $\frac{1}{2}$ rotation. Therefore, if 1/a is a reduction ratio of a pattern cam, the pattern cam has a configuration of at least $\frac{1}{2}\times 360°/a = 180°/a$ from the rotation center thereof, and has a number of equal circumferential faces defined by "a", which are spaced from each other by 360°/a and are generally of different radii and are connected to each other by the same number of circumferential faces.

"a" of the reduction ratio 1/a of the cam is a stitching number to be controlled by the cam during one rotation (hereafter caled as "1 cycle stitching number"). Therefore, when the pattern is stitched with said cam, and as the reduction ratio is made large, close stitching is possible in an ordinary pattern stitching with respect to various kinds of pattern stitchings, and in the super stitching its applicability is enlarged. Herein, considering examples of the stitching patterns by the cams of the reduction ratios being 1/6 and 1/12, the stitching patterns formed with the cam having 1 cycle stitching number being 6 and the reduction ratio of 1/6, are shown in FIGS. 1 to 3. In case of a simple zigzag stitching, such as shown in FIG. 1, 3, cycles are repeated during one rotation of the cam in reference to the right and left stitchings. In case of a tricot stitching such as shown in FIG. 2, stitchings, of 1 cycle shown with the numerals 1 to 6 in the same are formed during one rotation of the cam. In case of a honey stitching being one of super stitchings such as shown in FIG. 3, stitchings shown with the numerals 1 to 6 are formed during one rotation of the cam, and by this repetition the pattern as shown in the same may be formed.

FIGS. 4 and 5 show examples of stitching patterns which are formed with a cam having 1 cycle stitching number being 12 and the reduction ratio of 1/12. In a roam stitching shown in FIG. 4, a unit pattern shown with the numerals 1 to 12 may be formed during one rotation of the cam. If a pattern similar to the roam stitching is formed with such a cam, e.g., of the reduction ratio being 1/6, it is preferable in this kind of the pattern that a distance between the stitchings is close to a certain extent. However, if the stitching is performed with a distance being close to a certain extent as mentioned, the unit pattern is shortened in the feeding direction so that the stitching pattern is not preferable in shape.

FIG. 5 shows a pattern of the super stitching by the cam of the reduction ratio being 1/12. This pattern is not specially named. The stitchings shown with the numerals 1 to 12 are formed during one rotation of the cam, and the stitching pattern as shown in the same is formed by repeating the stitching. However this stitching pattern cannot be formed with the cam of 1/6 reduction ratio. Accordingly, when making much account of the applicability of the stitching pattern, it is preferable to make large the reduction ratio of the pattern cam, but when taking the sizing precision on the production into consideration, the actual size of a lift of the cam giving the maximum lateral amplitude to the needle bar cannot be made less than a certain predetermined ratio with respect to the maximum lateral amplitude of the needle bar, and accordingly the maximum outer diameter size of the cam cannot be made less than a certain size either, due to relation with the pressure angle, and the minimum size is settled down to a certain size. If only the reduction ratio is changed with respect to the main shaft of the sewing machine while maintaining other conditions constant, the maximum outer diameter of said cam is required to be larger as the reduction ratio is made larger in relation with the pressure angle of the cam face. When the cams are superimposed within the machine frame, volume occupying the narrow space within the machine frame is large so that the space for other built-in mechanisms is disadvantageously limited.

Thus, there have been conventionally the above mentioned two thinkings in the designing thoughts of the pattern generating cams. One of them makes large the reduction ratio of the pattern cam in view of the applicability of the stitching pattern, ignoring increase of the volume of the pattern generating cam group. The other makes small the reduction ratio of the pattern cam in view of the small volume of the pattern generating cam group, ignoring the applicability of the stitching pattern. These thoughts have still merits and demerits.

SUMMARY OF THE INVENTION

One object of the invention is to dispose, in the limited space of the arm frame of the sewing machine, the two groups of the needle bar swinging cams which are different in the reduction ratio with respect to the main shaft of the sewing machine, thereby to realize a stitching pattern selecting mechanism which may serve compactness of the pattern cam group of the small reduction ratio and the applicability of stitching of the pattern cam group of the large reduction ratio.

The other object of the invention is to exchange parts of the sewing machine of the conventional low grade, which houses therein the pattern cam group of the small reduction ratio, thereby to enable to change designing for different kind of a sewing machine where the stitching applicability is enlarged.

These and other objects are attained by a pattern selecting device for a sewing machine, comprising a first cam group for swinging the needle bar of the machine and adapted to be rotated at a predetermined speed reduced with respect to the speed of the main shaft of the sewing machine, a second cam group for swinging the needle bar, rotated at further speed reduction, and an amplitude transmission lever having a follower engageable with the cams of the first cam group. The lever is provided with two members each carrying a respective follower one of which is engageable with the cams of the second cam group and the other engageable with the pattern selecting cam controllable by a rotatable dial.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE INVENTION

Figure 1:
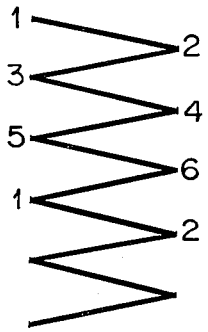
FIGS. 1 to 3 show examples of stitching patterns formed by the needle bar swinging cam where the reduction ratio is 1/6 with respect to the main shaft of the sewing machine.
Figure 2:
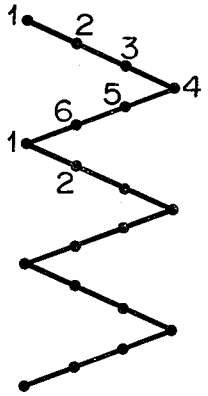
Figure 3:
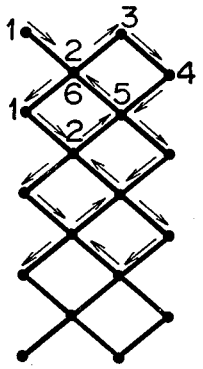
Figure 4:
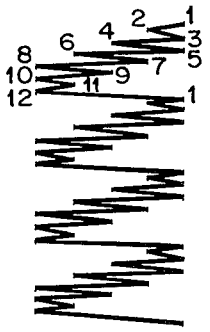
FIGS. 4 and 5 show examples of stitching patterns by the needle bar swinging cam where the reduction ratio is 1/12 with respect to the main shaft.
Figure 5:
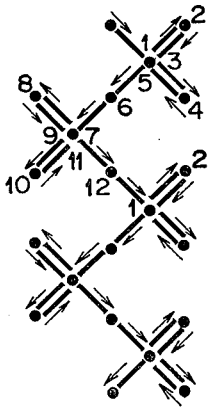
Figure 6:
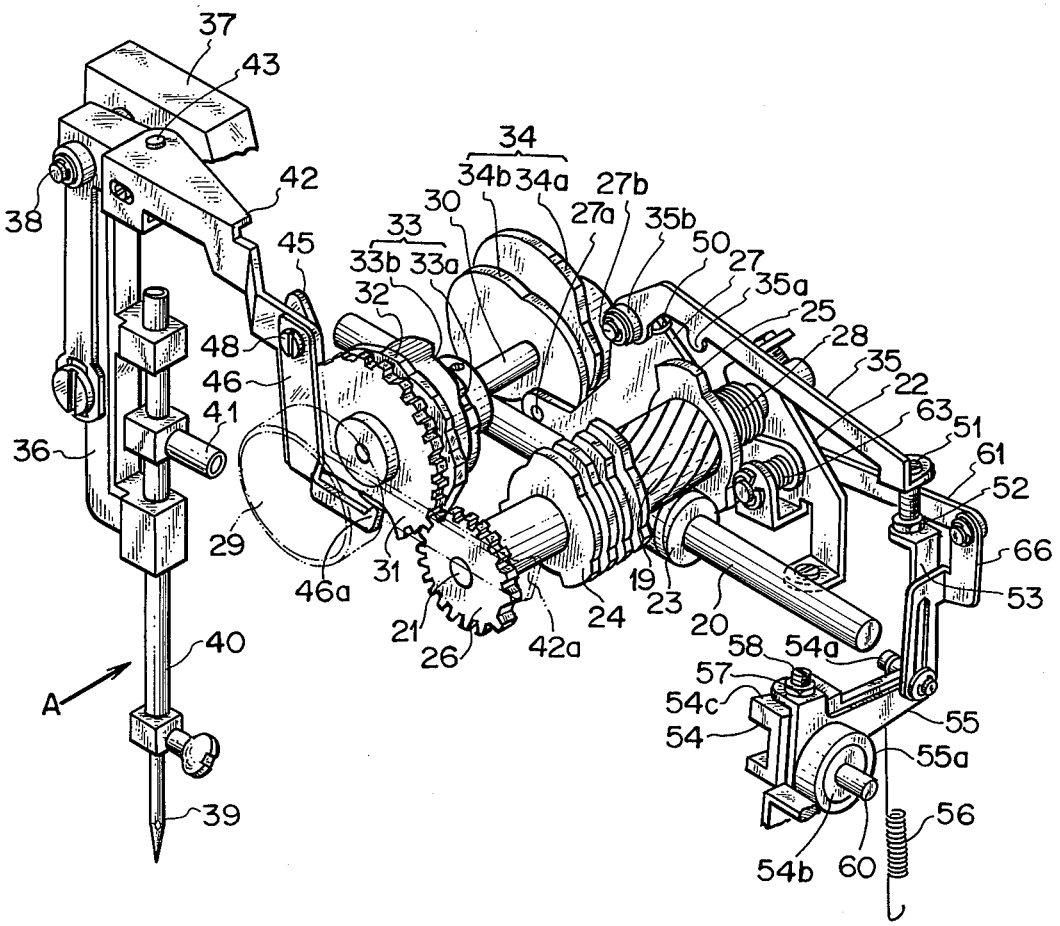
FIG. 6 is a perspective view of element parts of the pattern selecting mechanism according to the invention.

In FIG. 6, a main shaft 20 is rotatably supported to a machine frame and is rotated by a power source (not shown). A cam shaft 21 is supported between a bed plate 22 secured to the arm frame and the arm frame 37. A first cam group 24 for swinging the needle bar, which is rotated at reduction ratio of 1/6 with respect to the main shaft 20 in the present example, a feed changing cam 25 and a gear 26 are mounted on the shaft 21 and rotated via a worm wheel 19 gearing a worm 23 fixed on the main shaft 20. Further cam shaft 21 is connected to a selecting plate 27 which is biased by a spring 28 in the counterclockwise direction. An operating shaft 30 fixed with a pattern selecting dial 29 is parallel to the cam shaft 21. The rotatable operating shaft 30 is provided with a second cam group 32 for swinging the needle bar; the cam group 32 is formed integrally with a gear 31 to be rotated at further reduction and meshed with a gear 26 on shaft 21. The cam group 32 is rotated at the reduction speed of 1/12 with respect to the main shaft 20. The operating shaft 30 is secured to a selecting cam body 33 having an outer circumferential cam **33*a* and an inner cylindrical cam 33*b* for selecting a respective cam of the first cam group 24 and the second cam group 32. A cam body 34 having a feed cam 34*a*, which gives constant feed proper to each of the patterns for performing the zigzag stitching and a selecting cam 34*b* for super stitching is secured on shaft 30. The selecting cam 34*b* contacts a follower 35*a* of a feed arm 35 to the cam 25. The operating shaft 30 is rotated by the dial 29 outside of the sewing machine. The selecting cam 34*b* is followed by a part projecting to the selecting cam of a pin 27*a* of the selecting plate 27**.

A needle bar supporter 36 is pivoted to a pin 38 fixed to the arm frame 37 at its upper end, and is biased by a spring (not shown) in the counterclockwise direction about said pin, and holds a vertically moveable needle bar 40 having a needle 39 at its lower end. The needle bar 40 is moved vertically by a needle bar holder 41 and relative crank mechanisms (not shown) in association with rotation of the main shaft 20. An amplitude transmission lever 42 is pivoted with its base at an upper part of the needle bar holder 36 via a pin 43 as laterally rotated, and is biased to the clockwise direction about the pin 43. The lever 42 is formed at its end portion with a first follower **42*a* for swinging the needle bar, to be contacted to the first cam group 24 by biasing force of a spring (not shown). The amplitude transmission lever 42 is, at its central part, provided with a member 45 and a member 46 at the both sides thereof, which are secured to lever 42 by screws 47, 48 and a pin 49. The member 45 has a follower 45*a* (FIG. 8) integrally formed with an end point contacting portion which engages the outer circumferential cam 33*a* of the selecting cam body 33 and a side contacting portion which engages the cylindrical cam 33*b*. The member 46 has a second follower 46*a* to be contacted to the second cam group 32. With respect to the outer circumferential cam 33*a* and the cylindrical cam 33*b*, in the course of selecting the patterns, the first follower 42*a* is separated in the radial direction from the first cam group 24 by the outer circumferential cam 33*a* via the follower 45*a*, and the second follower 46*a* is separated in the radial direction from the second cam group 32, and the amplitude transmission lever 42 is rotated about the pin 43 by the cylindrical cam 33*b* via the follower 45*a*. As a result, the first follower 42*a* and the second follower 46*a* are moved to the superimposing position of the first cam group 24 and the second cam group 32, and then the first follower 42*a* or the second follower 46*a* is geared with one cam of the first cam group 24 or one cam of the second cam group, and in such a manner the pattern is selected. That is, one of the first follower 42*a* and the second follower 46*a* is engaged with one of the respective cam groups, whereby the other of them is separated from the superimposed position of the cam groups, and the pattern is selected. The feed arm 35 is mounted on a shaft portion 27*b* of the selecting plate 27 via a boss 35*b* and is biased to the counterclockwise direction about said shaft portion, and is inserted at its end hole with a screw 51 which secures a nut 52 and a rod 53 connected to a pin 54*a* of a feed adjuster 54. A boss 54*b* of the feed adjuster 54 is mounted within a boss 55*a* of the feed adjusting plate 55, the feed adjuster 54 being biased to the clockwise direction by a spring 56 which is fixed at its end to the pin 54*a*, and contacting with an upper face 54*c* the lower end of a screw 58 provided on the feed adjusting plate 55 together with a nut 57 in order to restrain the rotating motion. The feed adjuster is pivoted to a shaft 60** provided on the arm frame.

Figure 7:
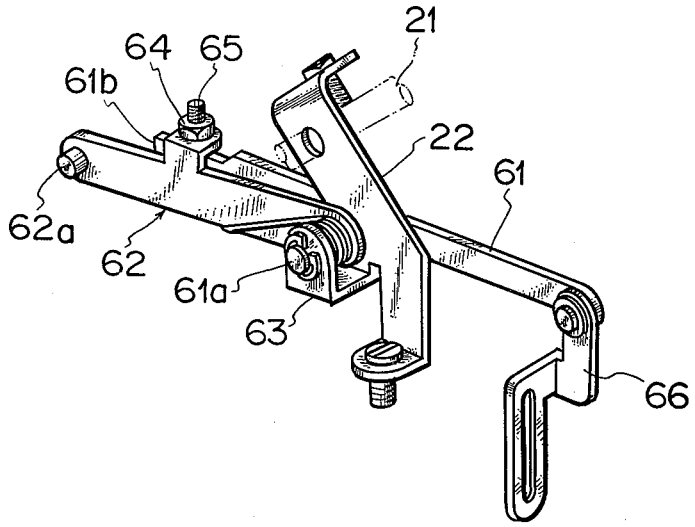
FIG. 7 is a perspective view of parts not shown in FIG. 6 showing a feed arm.

An explanation will be made in reference to FIG. 7. The feed arm 61 inserts its shaft portion **61*a* into holes of the bed plate 22, and one end of the selecting arm 62 is mounted thereon and is biased to the clockwise direction by a spring 63, and a pin 62***a* is followed by a feed cam 34*a*. A lower end portion of the screw 65 secured to the selecting arm 62 together with a nut 64 is contacted as later mentioned the upper face of the feed arm 61 when selecting the ordinary stitching. As mentioned above the feed adjuster 54 is biased by the spring 56 to the clockwise direction via the pin 54*a*, and biases the feed adjusting plate 55 via the screw 58 contacting the upper face 54*c* thereof, and biases the feed arm 61 to the clockwise direction about the shaft 61*a* of the feed arm via the rod 66. The upper face 61*b* of the feed arm 61 is, at selection of the ordinary stitching, contacted a lower face of the screw 65 secured to the selecting arm 62 which is limited in rotation to the clockwise direction by the feed cam 34*a* via the pin 62*a*. As a result, the feed adjuster 54 is made oblique in order to give the constant feed specific to the selected ordinary stitching pattern. In this case, the follower 35*a* of the feed arm 35 is separated from the cam 25 without giving influence to the oblique amount of the feed adjuster 54.

When the super stitching pattern is selected by rotation of the dial 29, one cam of the first cam group or the second cam group is selected as mentioned above, and the selecting plate 27 is rotated by the selecting cam 34*b* about the operating shaft 30 to the counterclockwise direction via the pin 27*a*. The follower 35*a* of the feed arm 35 is geared with the cam 25, and the selecting arm 62 is rotated by the feed cam 34*a* to the counterclockwise direction, and the lower end of the screw 65 is separated from the upper face 61*b* of the feed arm 61. The feed adjuster 54 is limited in its obliquity by the cam 25 to automatically control forward and backward feed, and in the present embodiment repetition of forward-forward-backward feeds.

Figure 9:
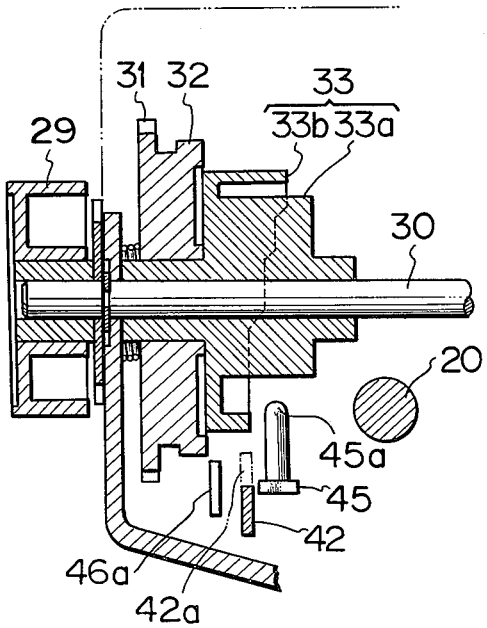
FIG. 9 is a vertical cross sectional view on line B—B of FIG. 8.
Figure 8:
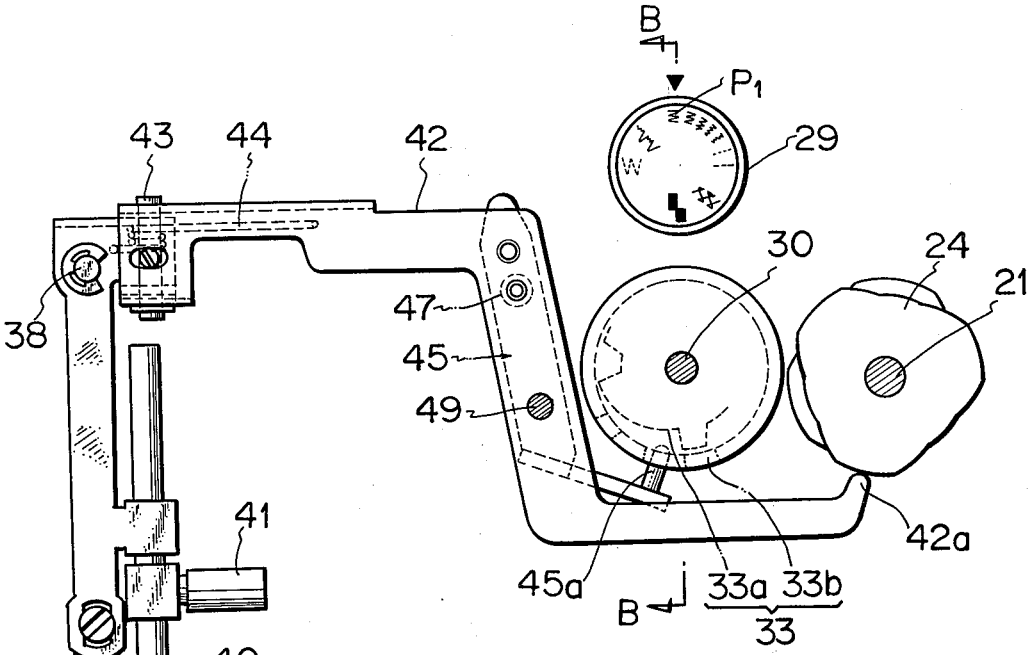
FIG. 8 shows a side view seen from an arrow A in FIG. 6 and illustrating selection of one pattern.

In the present embodiment, the first cam group 24 is arranged with the cam for the ordinary stitching pattern and the second cam group 32 is arranged with the cam for the needle swinging amplitude in order to form the super stitching by actuation of the cam 25 in association with operation of the dial 29. However, the invention is not of course limited to such combinations, and available to other combinations in accordance with sorts of the stitching patterns or necessities;

The arrangement of the actuation of the invention will be referred to. FIGS. 8 and 9 which show the case of selecting the zigzag pattern by rotation of the dial 29, which is one of the ordinary stitchings. In the course of selecting the pattern by the dial 29, the first follower 42*a* is separated from the first cam group 24 in the radial direction by the outer circumferential cam 33*a* via the follower 45*a*; the second follower 46*a* is separated from the second cam group 32 in the radial direction; the amplitude transmission lever 42 is rotated by the cylindrical cam 33*b* about the pin 43 via the follower 45*a* so that the first follower 42*a* and the second follower 46*a* are moved to the superimposing position of the first cam group 24 and the second cam group 32; and then one of the first follower 42*a* or the second follower 46*a* is engaged with the respective cam for the stitching pattern; and when the zigzag pattern shown with $P_1$ is selected by the dial 29, the first follower 42*a* is, in this embodiment, engaged with the zigzag pattern stitching cam of the first cam group 24; the second follower 46*a* is made different in the position of its superimposing direction from the second cam group 32 as shown in FIG. 9 and engages none of the cams of the second cam group 32; and the constant feed specific to the zigzag stitching pattern is given by the feed cam 34*a* at the operating position of the dial 29.

Figure 11:
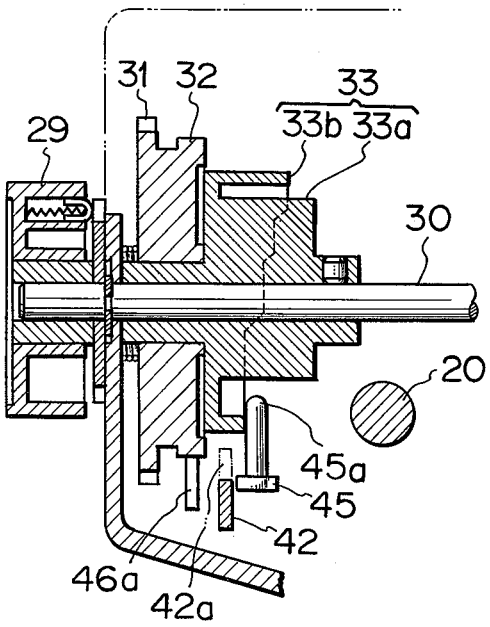
FIG. 11 is a cross sectional view seen on line C—C of FIG. 10.
Figure 10:
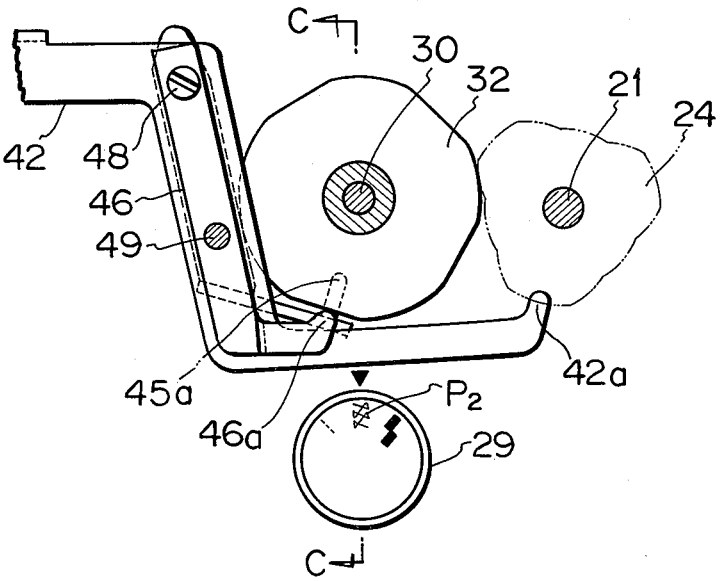
FIG. 10 is a view of element parts seen from the arrow A in FIG. 6, but showing a different selection from that of FIG. 8.

A further explanation will be made to the case of selecting the super pattern stitching in reference to FIGS. 10 and 11. When selecting the pattern shown with $P_2$ by the dial 29, which is one of the super pattern stitchings, the second follower 46*a* is, in this embodiment, engaged with one of the cams of the second cam group 32 by the cam 33 via the follower 45*a* in the same manner as mentioned above, and the first follower 42*a* is made different in the position of its superimposing direction from the first cam group 24 and at this time engages none of the cams of the first cam group 24. The selecting plate 27 is rotated by the selecting cam 34*b* to the counterclockwise direction about the operating shaft 30 via the pin 27*a* at the operating position of the dial 29, and the follower 35*a* of the feed arm 35 is engaged with the cam 25; the feed adjuster 54 is limited in its obliquity as above mentioned, and the super stitching pattern is performed due to the composition of amplitude control of the cam selected from the second cam group 32.

Considering the structure on this embodiment of the invention, for example, in the sewing machine serving the ordinary stitching and super stitching functions, the cam for the needle bar amplitude is exchanged with the first cam group 24 with respect to a kind of the sewing machine of the relatively low grade function which is structured with the needle bar amplitude cam groups of all 1/6 speed reduction ratio for each of the stitching patterns, and the selecting cam body for selecting said cam group for the needle bar amplitude is exchanged with the selecting cam body 33 of the invention in order to meet interrelation between the feed cam 34*a* and a portion corresponding to the selecting cam 34*b*, as well as such addition is made with respect to the gear 26, the gear 31 and the second cam group 31 and the member 46 having the second follower 46*a*, for controlling the interrelation, whereby the designing may be easily changed from the sewing machine of the relatively low grade function to the kind of the sewing machine in which the applicability of stitching is enlarged.

Thus, according to the invention, the prime object thereof is to dispose, in the limited space of the arm frame of the sewing machine, the two groups of the needle bar swinging cams which are different in the reduction ratio with respect to the main shaft of the sewing machine, thereby to realise a stitching pattern selecting machanism which may serve the compactness of the pattern cam group of the small reduction ratio and the applicability of stitching of the pattern cam group of the large reduction ratio; and the second object is to exchange the respective parts of the sewing machine of the conventional low grade, which sewing machine houses therein the pattern cam group of the small reduction ratio, thereby to enable to change the designating for different kind of a sewing machine where the stitching applicability is enlarged.

The cam groups are not limited to the first and second groups shown but may be further available in a third and a fourth different group.

It will be understood that each of the elements described above, or two or more together, may also find a useful application in other types of pattern selecting devices differing from the types described above.

While the invention has been illustrated and described as embodied in a pattern selecting device for a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pattern selecting device for a sewing machine having a housing, a rotatable main shaft and a swingable and reciprocally movable needle bar, comprising at least one pattern selecting cam operated by a rotatable pattern selecting dial; a cam shaft operatively connected to the main shaft; a first cam group on said cam shaft and having a number of cams for swinging the needle bar and adapted to be rotated at a predetermined speed reduction with respect to the speed of the main shaft; an operating shaft extending parallel to said cam shaft; a second cam group on said operating shaft and having a number of cams for swinging the needle bar and adapted to be rotated at further reduced speed with respect to said first cam group, said pattern selecting cam and said dial being mounted on said operating shaft; and an amplitude transmission lever operatively connected to the needle bar and having a first follower engageable with said first cam group, said amplitude transmission lever being provided with a first member having a second follower engageable with said pattern selecting cam, and a second member having a third follower engageable with said second cam group, said second follower being controlled by said pattern selecting cam so that said first follower engages one of the cams of said first cam group when said third follower disengages from one of the cams of said second cam group and said third follower engages with one of the cams of said second group when said first follower disengages from one of the cams of said first cam group.

2. The device of claim 1, wherein the needle bar is supported in a needle bar support, said amplitude transmission lever being pivotable on said needle bar support.

3. The device of claim 2, said first member and said second member being arranged on the opposite sides of said amplitude transmission lever.

4. The device of claim 2, wherein said first follower is integral with said amplitude transmission lever and formed at the end thereof.

* * * * *